United States Patent [19]

Kawabata et al.

[11] Patent Number: 4,930,416

[45] Date of Patent: Jun. 5, 1990

[54] APPARATUS FOR QUICKLY DISCHARGING INK FROM INK SUPPLY DEVICE

[75] Inventors: Takanobu Kawabata; Noritake Harada, both of Yokohama, Japan

[73] Assignee: Kabushiki Kaisha Tokyo Kikai Seisakusho, Tokyo, Japan

[21] Appl. No.: 262,895

[22] Filed: Oct. 26, 1988

[30] Foreign Application Priority Data

Mar. 2, 1988 [JP] Japan ..... 63-49314

[51] Int. Cl.[5] ..... B41F 31/06; B41L 27/08

[52] U.S. Cl. ..... 101/364

[58] Field of Search ..... 101/366, 350, 363, 207, 101/208, 209–210, 364–366

[56] References Cited

U.S. PATENT DOCUMENTS 3,065,693 11/1962 Neal et al. ..... 101/366

3,589,287 6/1971 Woessner ..... 101/363

FOREIGN PATENT DOCUMENTS 35-12862 9/1960 Japan .

39-5717 4/1964 Japan .

59-393 1/1984 Japan .

*Primary Examiner*—J. Reed Fisher

*Attorney, Agent, or Firm*—R. A. Giangiorgi

[57] ABSTRACT

In an ink supply device having an ink reserve vessel being composed of a bottom member and surrounding side wall members, means for shifting one member of the bottom and surrounding side wall members between a closed position contacting the one member with the other members to form the ink reserve vessel and an open position separating the one member from the other members at the bottom level of the ink reserve vessel are provided for quickly discharging ink therefrom.

1 Claim, 3 Drawing Sheets

APPARATUS FOR QUICKLY DISCHARGING INK FROM INK SUPPLY DEVICE

BACKGROUND OF THE INVENTION

1. Field of the Invention

This invention relates to an apparatus for quick discharging ink from an ink supply device of a printing machine, and more particularly, to an ink reserve vessel of an ink supply section of the ink fountain type including, in addition to the ink reserve vessel called ink fountain or ink pan, an ink transfer medium called fountain roller for taking out ink by being partly soaked in ink held in the ink reserve vessel, and to an ink supply device.

2. Description of the Prior Art

Conventional ink supply devices of the foregoing type are of the two-stage system which is featured in that an ink tank is provided on the back side of an ink reserve vessel for storing a comparatively large quantity of ink, ink being supplied is once stored in the ink tank, and then an adequate quantity of ink is supplied bit by bit from the ink tank through a pipe to the ink reserve vessel (see Japanese Patent Publication Nos. 35-12862, 39-5717 and 59-393).

Specifically, conventional ink supply devices of the foregoing system are designed, without considering the case of quick discharging of ink in the course of printing, such that an adequate quantity of ink is continuously supplemented from the ink tank to the ink reserve vessel and the thus supplemented ink held in the reserve vessel is supplied to a plate drum by means of an ink transfer medium. Therefore, as far as the conventional devices are used in a mode where the supply direction of ink is not disturbed, there occurs no inconvenience.

On the other hand, it has been found that although the quality of printing cannot be improved if the ink is supplied at room temperature as in the prior art, it can be remarkably enhanced if the ink being supplemented to the ink fountain is supplied, during the whole period of printing, with a substantially uniform physical property which is restored when the ink is heated to a specified temperature. When putting the foregoing discovery into practice, since the ink held in the ink reserve vessel has no desired temperature with its physical property having changed at the moment when the printing machine is going to restart after a long interval of down time, all ink of low temperature remaining in the ink fountain must be quickly returned into the ink tank.

For example, when a change of the fountain roller is desired to be made to deal with the occurrence of some inconvenient situation, it is required to quickly discharge the ink held in the reserve vessel and to fill the reserve vessel with new one.

To cope with such a case, as shown in FIG. 5, the conventional machine has only an ordinary discharge hole 2*f* bored at one bottom corner of an ink reserve vessel 2. When viscous ink is allowed to discharge through such a hole, it takes a long interval of time until the completion of discharging; thus, the work of printing is delayed correspondingly.

As another measure of solving the foregoing problem, one may consider discharging the ink by detaching the ink reserve vessel from its attaching frame; but, this procedure needs much labor and time in detaching and discharging, and mental fatigue is appreciably imposed on workers doing such dirty work.

SUMMARY OF THE INVENTION

It is an object of the present invention to provide an ink reserve vessel allowing quick discharging of ink.

It is another object of the present invention to provide an ink supply device including a novel ink reserve vessel as above.

To achieve the foregoing objects, in an ink supply device having an ink reserve vessel being composed of a bottom member and surrounding side wall member, means for shifting one member of the bottom and surrounding side wall members between a closed position contacting the one member with the other members to form the ink reserve vessel and an open position separating the one member from the other members at the bottom level of the ink reserve vessel are provided for quickly discharging ink therefrom.

In the foregoing structure, if the open/close-able face member is closed, ink is stored in the reserve vessel, permitting the function of the ink transfer medium to be effectively exerted, thereby achieving the supply of ink.

If the open/close-able face member is opened, the ink in the reserve vessel is discharged through its opened portion in a very short time, and the thus discharged ink can be returned into an ink tank or thrown away.

After the completion of discharging of the ink in the reserve vessel, the open/close-able face member is closed, allowing the supply of new ink from the ink tank to the reserve vessel, whereby the reserve vessel can be filled with new ink of optimal physical property.

DESCRIPTION OF THE PREFERRED EMBODIMENTS

An embodiment of the present invention will now be described.

Figure 1:
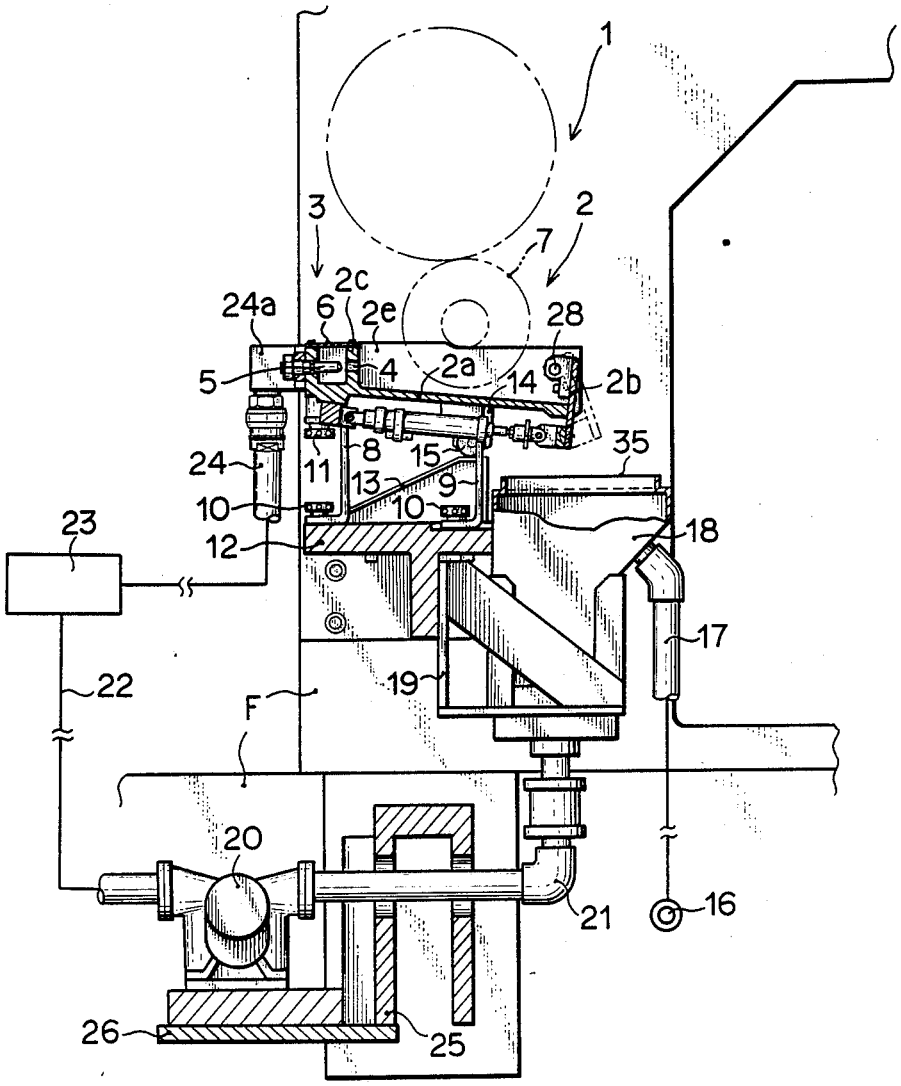
FIG. 1 is an elevational view, partly in cross section, showing an embodiment of the present invention.
Figure 2:
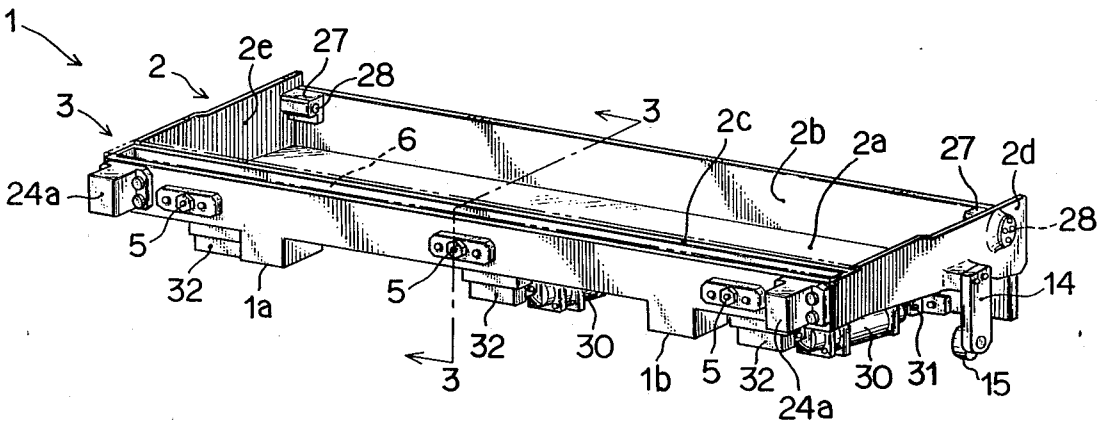
FIG. 2 is a perspective view of an ink reserve section shown in FIG. 1.

As shown in FIG. 1, an ink supply device of the ink fountain type includes an ink reserve vessel 2 which is generally called ink fountain or ink pan and an ink transfer medium such as a fountain roller 7 which is partly soaked in ink held in the reserve vessel, this ink reserve vessel 2 together with an ink supplement gutter 3 forming an ink reserve section 1.

The ink reserve vessel 2 is a receptacle generally of rectangular shape, especially of quadrangular shape, which is composed of a bottom member 2*a* and surrounding side wall members 2*b*, 2*c*, 2*d* and 2*e*. According to the present invention, a part or the whole of at least one face member out of the bottom member 2*a* and side wall members 2*b*, 2*c*, 2*d* and 2*e* making up the receptacle or the ink reserve vessel 2 is made open/close-able.

Figure 3:
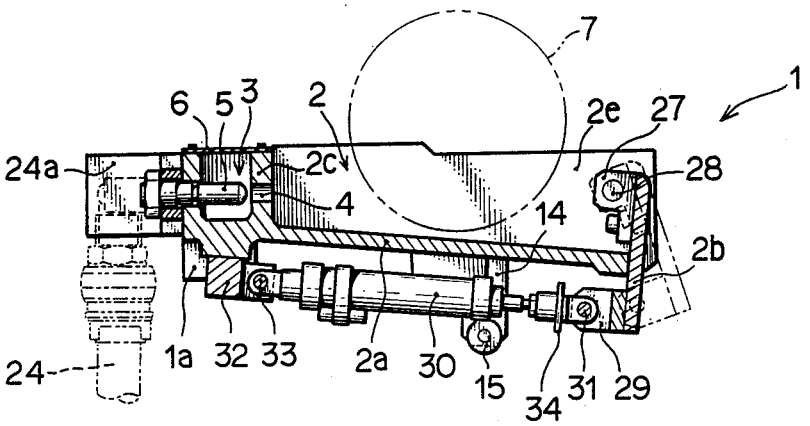
FIG. 3 is a vertical sectional view taken along line 3—3 in FIG. 2.

The embodiment shown in the drawings is designed such that the whole face of the longitudinal side wall member 2*b* of the reserve vessel 2 can be opened/closed by an angular shifting means. Specifically, brackets 27 and 27 provided in the upper corners of the side wall member 2*b* are swingably pivoted to shafts 28 and 28 of the side wall members 2*d* and 2*e* adjacent thereto, a bracket 29 provided on the inner side of the lower edge of the side wall member 2*b* is connected swingably via a pin 31 to the distal end of the rod of an air cylinder 30, and the other end or base end of the air cylinder 30 is pivoted swingably via a pin 33 to a bracket 32 projecting from the under extension surface of the bottom member 2*a*. Accordingly, as shown in FIG. 3, the side wall member 2*b* is closed (assuming the solid line position) when the rod is retracted, or opened (assuming the two-dot chain line position) when it is extended, so that in the opened state the ink held in the ink reserve vessel 2 is discharged.

Incidentally, to prevent the ink, discharged when the side wall member 2*b* is opened, from coming round to the air cylinder 30, the distal end of the rod has a wide collar 34 attached thereto.

Further, it is desirable that a part or the whole of at least the inner surface of the bottom member 2*a* of the ink reserve vessel 2 be made oblique such that the inner surface is progressively decreased in height toward the open/close-able side wall member 2*b*. If configured so, due to such inclination the natural falling and discharging of the ink proceeds very smoothly and quickly.

The ink reserve vessel 2 abuts on the ink supplement gutter 3 via a partition 2*c* which is one of the foregoing side wall members, and the ink is supplied from the gutter 3 to the reserve vessel 2 through ink supplement holes 4 bored at adequate positions in the partition 2*c*.

Figure 4:
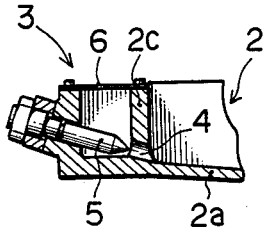
FIG. 4 is a vertical sectional view showing another embodiment of an ink supplement hole shown in FIG. 3 at left.

In connection with the inlet of each ink supplement hole 4, a valve 5 whose valve seat is replaced with the inlet is provided opposite to the hole on the extension line thereof. Therefore, the ink whose flow rate is in excess of the amount of ink consumed by printing can be supplemented to the ink reserve vessel 2 by the regulation of the amount of ink supplement through the hole 4 that is carried out by controlling the valve 5, whereby the ink level of the reserve vessel 2 can always be maintained constant. Incidentally, the upper side of the gutter 3 is covered with a lid member 6.

Where it is desired to exert the effect of ink discharging according to the present invention on the ink held in the ink supplement gutter 3, as shown in FIG. 4, the inlet of the ink supplement hole 4 is made flush with the inner bottom surface of the gutter 3, the hole is made oblique downward, and the attaching direction of the ink-supplement-amount regulating valve 5 is made to accord with the extension line of the inclined hole. Further, if the inner bottom surface of the gutter 3 is also made oblique so as to accord with the inclination direction of the ink supplement hole 4 (this is not shown), the discharging of the ink takes place thoroughly furthermore.

The reserve section 1 which is an integral combination of the ink reserve vessel 2 and the gutter 3 is attached and secured to the upper side of a first stay 12, that is, its attaching seats 1*a* and 1*b* are secured via a pair of brackets 8 and 9 by means of screw members 10 and 11, and a wheel 15 supported by a bracket 14 provided on the under side of the ink reserve section 1 is fitted to an inclined portion of an inclined guide member 13 independently provided on the first stay 12. Accordingly, when detaching the ink reserve section 1 from the first stay 12, unfasten the screw members 10 and 11, remove the pair of brackets 8 and 9, and lower the section 1 while allowing the wheel 15 to move along the inclination of the inclined guide member 13. As a result, the ink reserve section 1 moves obliquely leftward and downward in FIG. 1, thereby being smoothly detached without colliding with the fountain roller 7 and the other members. The first stay 12 is supported between parallel frames F and F of a pair (the other frame is omitted from the drawing).

An example of the structure of supplying the ink to the ink reserve section 1 will now be described.

In FIG. 1, the ink introduced through an ink supply source pipe 16 is supplied through a first junction pipe 17 to an ink tank 18.

The ink tank 18 is secured via a bracket 19 to the right side surface of the first stay 12 and has an ink level detecting means of known configuration (not shown) provided thereinside. When the ink in the tank decreases so that the ink surface lowers beyond a predetermined level, a valve not shown provided in the first junction pipe 17 is opened; as a result, the ink is supplied from the supply source pipe 16 through the first junction pipe 17 into the tank 18. When the ink surface reaches a predetermined level, the level detecting means is actuated; as a result, the valve is closed to stop the supply of ink.

Owing to the actuation of an ink pump 20 attached via a bracket 26 to a second stay 25 supported by the frame F, the ink in the ink tank 18 is sent through a second junction pipe 21, the ink pump 20, a third junction pipe 22, a fourth junction pipe 24 and a piping block 24*a* into the ink supplement gutter 3 of the reserve section 1.

In the present invention, an ink temperature regulating means 23 is provided in an ink circulation path formed between the ink tank 18 and the ink reserve vessel 2.

The ink temperature regulating means 23 heats/cools the ink by means of, for example, a heat exchanger not shown to keep the ink always at temperatures best suited for printing, the ink then being supplied to the ink reserve vessel 2. Incidentally, in addition to or instead of this regulating means 23, other means may be provided which are for regulating the components, viscosity, moisture content, etc. of the ink.

In the present invention, further, as shown in FIG. 1, the ink tank 18 is located below the open/close-able side wall member 2*b*, with the upper side of the tank being provided with an opening portion 35. Accordingly, when the ink is discharged as the result of opening of the side wall member 2*b* and when the ink runs over the upper edge of the side wall member 2*b* of the ink reserve vessel 2 (this occurs because the upper edge of the side wall member 2*b* is previously made lower than the other edges), these drops of ink are collected through the opening portion 35 into the ink tank 18.

If it is not desired to collect the ink being discharged at the ink tank 18, for example, when the ink is diluted with water or mixed with a plenty of foreign materials such as pieces of paper, another gutter not shown may be provided above the ink tank 18 to discharge such ink outward.

It is not intended to have the present invention limited to the foregoing embodiments thereof, and it should be understood that many changes and modifications may be made without departing from the scope of the appended claims.

Figure 5:
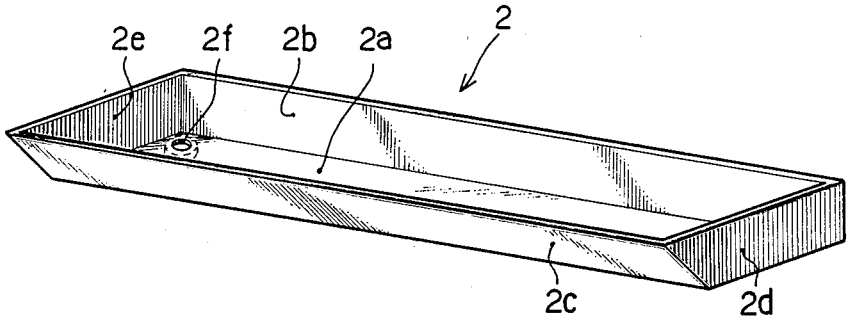
FIG. 5 PRIOR ART
FIG. 5 is a perspective view showing an ink discharge hole of a conventional ink reserve vessel.

As described above, when it is desired to quickly discharge the ink in the ink reserve vessel 1 for some reasons, in the prior art, the discharging of ink is effected by causing the ink to flow through the well-known ink discharge hole 2f (see FIG. 5) or by detaching the ink reserve section 1 from the printing machine. On the contrary, according to the present invention, a part or the whole of at least one face member 2b forming part of the ink reserve vessel 2 is opened, whereby the ink in the vessel can be quickly discharged at a stretch.

Further, if at least the inner surface of the bottom member 2a of the ink reserve vessel 2 is made oblique or progressively decreased in height toward the open/-close-able face members 2b, the ink in the reserve vessel 2 can be smoothly and quickly discharged furthermore.

Further, since the open/close motion of the face member is electromechanically caused automatically by the depression of a button not shown that results in an angular shift of, for example, the air cylinder 30, worker's hands and/or clothes are prevented from becoming dirty because the work of detaching the ink reserve vessel is not required as contrasted with the prior art, and the work of ink discharging can be completed in a short time.

What is claimed is:

1. An apparatus for quickly discharging ink from a ink supply device including an ink reserve vessel being composed of a bottom member and surrounding side wall members;

means for shifting at least a portion of at least one member of said bottom and surrounding side wall members between a closed position in which said at least one member contacts said other members to form said ink reserve vessel and an open position in which said at least one member separates from the said other members adjacent the bottom level of said ink reserve vessel;

at least a portion of the inner surface of said bottom member directed obliquely such that said inner surface is progressively decreased in height toward said at least one member;

an ink supplement gutter which abuts on said ink reserve vessel via a partition formed by one of said surrounding side wall members;

ink supplement holes extending through said partition and inclined obliquely downward;

valves providing inlets to said ink supplement holes and located in opposing alignment with said ink supplement holes;

and said inlets being flush with the inner bottom surface of said ink supplement gutter.

* * * * *